United States Patent [19]

van Manen

[11] 4,077,550

[45] Mar. 7, 1978

[54] INTERLOCK WITH INSIDE OF CYLINDER

[75] Inventor: Dick T. van Manen, Canandaigua, N.Y.

[73] Assignee: Voplex Corporation, Pittsford, N.Y.

[21] Appl. No.: 697,866

[22] Filed: Jun. 21, 1976

[51] Int. Cl.[2] ..... G01F 11/04

[52] U.S. Cl. ..... 222/327; 222/386; 24/217

[58] Field of Search ..... 285/424, DIG. 2, DIG. 22, 285/305, 307; 138/89, 96; 220/352, 307, 315, 93; 24/208 A, 217; 222/327, 326, 386, 387-391, 393; 229/93; 85/82; 128/218 PA, 218 R; 92/169, 170, 172; 184/38 R, 48 R, 48 A; 401/171, 176

[56] References Cited

U.S. PATENT DOCUMENTS

| | | | |
|---|---|---|---|
| 2,098,408 | 11/1937 | Watson | 222/386 |
| 2,244,222 | 6/1941 | Slootsky | 229/93 |
| 2,592,130 | 4/1952 | Erb et al. | 85/82 |
| 2,752,074 | 6/1956 | Martin | 222/326 |
| 2,869,099 | 1/1959 | Robinson | 285/DIG. 22 |
| 3,211,347 | 10/1965 | Phillips | 222/386 |
| 3,532,372 | 10/1970 | Stroud | 220/307 |

FOREIGN PATENT DOCUMENTS

| | | | |
|---|---|---|---|
| 353,717 | 7/1931 | United Kingdom | 229/93 |
| 878,456 | 9/1961 | United Kingdom | 222/327 |

*Primary Examiner*—Robert B. Reeves
*Assistant Examiner*—H. Grant Skaggs
*Attorney, Agent, or Firm*—Stonebraker, Shepard & Stephens

[57] ABSTRACT

A cylinder, such as the barrel of a caulking cartridge, interlocks with an internal member, such as the closure plunger for the caulker, by means of two to four cuts through the cylinder wall evenly spaced from the end of the cylinder to form catches from the segments of the wall between each of the cuts in the end of the cylinder. The catches are longer circumferentially of the wall than their width from the cut to the end of the cylinder, and they are deformed inward from the locus of the cylindrical wall toward a chord orientation. The member has a body fitting the inside of the cylinder and slidable past the catches, and the body is seated inside the cylinder so the catches are disposed between the body and the end of the cylinder to interlock with the body to prevent its movement out of the end of the cylinder. The cuts and catches can be formed either before or after the member is seated in the cylinder, and the inward deformation of the catches to insure an interlock can be accomplished by the way the cuts are formed, or by an interference fit between the member and the cylinder, or both.

11 Claims, 7 Drawing Figures

INTERLOCK WITH INSIDE OF CYLINDER

BACKGROUND OF THE INVENTION

The invention occurred relative to resin cartridges for sealants and caulking compounds, often called "caulkers" in the art. Caulkers have a closure member that serves as a plunger to expel the contents on demand, and various circumstances can cause the plunger to back out of a fully loaded caulker to waste the contents and spoil other caulkers in the same carton. Thermal expansion of the contents, entrapped air, or gasses produced by reactions with the contents can back the plunger out, and this mishap can be facilitated by improper placement or dimensioning of the plunger relative to the caulker. The problem is substantial enough to warrant a simple solution, and yet none has been satisfactory in the art.

The invention aims at a simple, economical, and reliable way of providing an interlock between the inside of a cylinder and a member fitting into the inside of the cylinder, not only as applied to the barrels and closure plungers of caulkers, but possibly also to mailing tubes and other uses where a simple and reliable interlock is desired between a cylinder and an internal member.

SUMMARY OF THE INVENTION

The inventive interlock applies to a cylinder having a resiliently deformable wall and a member fitting into the inside of an end region of the cylinder. It includes several discrete through cuts evenly spaced from the end of the cylinder and positioned to form catches from the segments of the wall between each of the cuts and the end of the cylinder. The catches are longer circumferentially of the wall than their width from the cuts to the end of the cylinder, and they are deformed inward from the locus of the cylindrical wall toward a chord orientation relative to the cylindrical locus. The member has a body fitting the inside of the cylinder and slidable past the catches, and the body is seated inside the cylinder so the catches are disposed between the body and the end of the cylinder to interlock with the body and prevent movement of the body toward the end of the cylinder. The catches can be deformed inwardly by means of an interference fit between the body and the cylinder for radially expanding the cylindrical wall slightly, by the cuts being at an angle oblique to a plane perpendicular to the axis of the cylinder so the catches are slightly wider at their inside surfaces than at their outside surfaces, by the catches being wider at their midregions than at their end regions, or by any combination of these measures.

DRAWINGS

DETAILED DESCRIPTION

Figure 1:
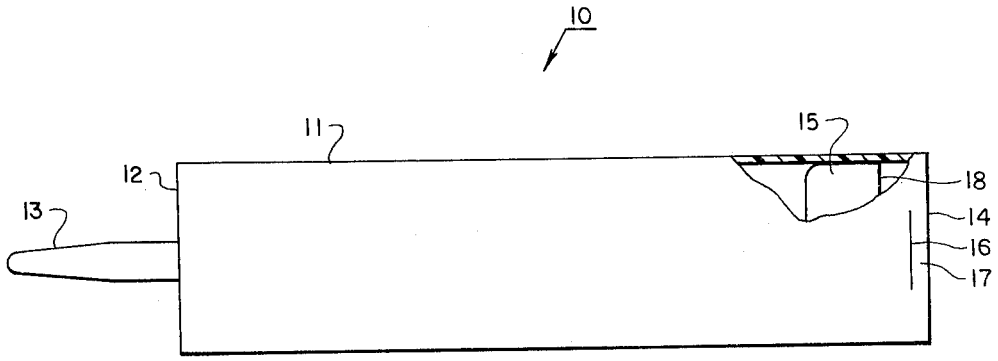
FIG. 1 is a partially cut-away, side elevational view of one preferred embodiment of the invention interlock as applied to a caulker.

Although the invention is shown in the drawings as applied to an interlock between a closure plunger and a resin-barreled caulker for sealants and caulking compounds, it also applies to mailing tubes and other devices where an interlock is desired between a cylinder having a wall formed of resin or other resiliently deformable material and an internal member to be interlocked with an end region of the cylinder. For convenience of description, the invention will be explained as applied to interlocks between caulkers and closure plungers for caulkers, even though it is not limited to this use.

Caulker 10 of FIG. 1 has a conventional barrel 11 preferably formed of resin material to be generally self supporting, slightly resiliently deformable, and able to withstand moderate pressure from its contents. Caulker 10 has an end cap 12 with a nozzle 13 for dispensing the contents, which are expelled on demand by a closure plunger 15 seated inside the rear end 14 of barrel 11. The invention involves a simple interlock between barrel 11 and plunger 15 to prevent plunger 15 from backing out of rear end 14 of barrel 11.

A pair of cuts 16 are made through the wall of barrel 11 and spaced evenly from the end 14 of barrel 11 to form a pair of diametrically opposed catches 17 from the segment of the barrel wall between each of the cuts 16 and the cylinder end 14. Each of the catches 17 has a length circumferentially of the barrel wall 11 along the length of cut 16 longer than the width of catches 17 from cuts 16 to the cylinder end 14.

Figure 2:
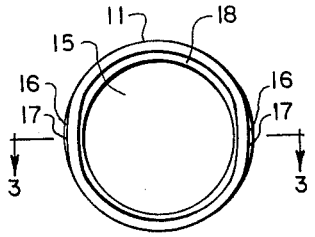
FIG. 2 is a rear end elevational view of the interlock of FIG. 1.
Figure 3:
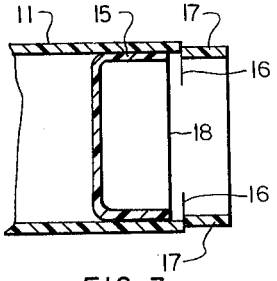
FIG. 3 is a cross-sectional view of the interlock of FIG. 2 taken along the line 3—3 thereof.

As best shown in FIGS. 2 and 3, catches 17 are deformed inwardly from the locus of the cylindrical wall of barrel 11 toward a chord orientation relative to cylinder 11 because of an interference fit with plunger 15 radially expanding barrel wall 11 slightly. The radial expansion of barrel wall 11 from the interference fit with plunger 15 not only seats plunger 15 securely and tightly within caulker 10, but is sufficient to draw catches 17 inward toward a chord orientation after plunger 15 is inserted past cuts 16. The trailing edge 18 of plunger 15 is then trapped inside the end region of barrel 11 by an interlock with catches 17 so that plunger 15 cannot move rearwardly past catches 17 toward cylinder end 14. Caulker 10 is preferably strong enough to withstand the pressure from expansion of contents or trapped gasses that urge plunger 15 into a firm interlock with catches 17.

Figure 4:
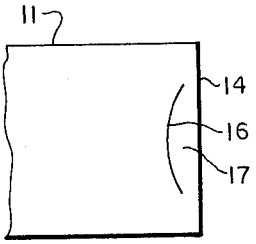
FIGS. 4 and 5 are fragmentary, side elevational views of other preferred embodiments of the preferred interlock.
Figure 5:
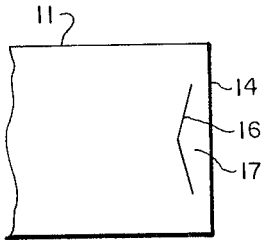

Instead of being straight, as shown in FIGS. 1–3, cuts 16 can be curved as shown in FIG. 4, or angled as shown in FIG. 5 to form catches 17 that are wider at their midregions than at their end regions. This helps deform the axially inward edge of catches 17 inward toward the chord position to insure an interlock wit plunger 15, and it reduces or eliminates the need for an interference fit between cylinder 11 and internal member 15 to insure an interlock with catches 17.

Figure 6:
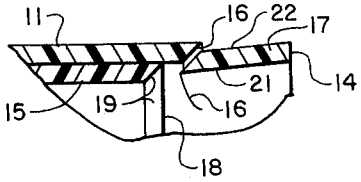
FIG. 6 is an enlarged, fragmentary view similar to the view of FIG. 3 and showing another preferred embodiment of the inventive interlock.

Another preferred variation is shown in FIG. 6, where cuts 16 are made at an angle oblique to a plane perpendicular to the axis of cylinder 11 so that catches 17 are slightly wider along their inside surfaces 21 than along their outside surfaces 22. This also tends to deform catches 17 radially inward toward a chord orientation relative to cylinder 11 to insure an interlock with internal member 15 without relying on an interference fit.

FIG. 6 shows another way that the inventive interlock is facilitated by use of an inside bevel 19 on the trailing edge 18 of plunger or closure member 15. Bevel 19 helps insure that trailing edge 18 of member 15 interlocks with catches 17, especially if cut 16 is made at an angle as shown in FIG. 6.

Any combination of the expedients of FIGS. 1–6 can be used to insure inward deformation of catches 17 to secure an interlock with internal member 15. For example, cuts 16 can be curved as shown in FIG. 4, angled obliquely to a plane perpendicular to the axis of cylinder 11 as shown in FIG. 6, and some interference in the fit between cylinder 11 and internal member 15 can be added to insure a reliable interlock. In any preferred arrangement, member 15 is slidable past catches 17 for insertion into cylinder 11 after cuts 16 have been made, but member 15 can also be seated in place before cuts 16 are made.

Figure 7:
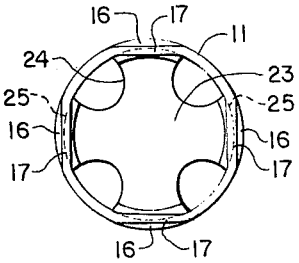
FIG. 7 is a rear elevational view of another preferred embodiment of the inventive interlock.

Instead of a cylindrical internal closure member 15, the internal member need not fit cylinder 11 tightly all around the internal circumference of cylinder 11, and can have internal openings 24 as illustrated by internal member 23 of FIG. 7. Also, instead of a pair of diametrically opposed cuts 16, three or four cuts 16 can be used, and four cuts 16 are illustrated in FIG. 7. Internal member 23 has cylindrical portions 25 fitting the inside of cylinder 11 adjacent the region of each of the cuts 16 and preferably has an interference fit slightly expanding cylinder 11 radially to deform each of the catches 17 radially inward as illustrated for an interlock between cylinder 11 and internal member 23. Member 23 can also be inserted into the end of cylinder 11 past catches 17 and then rotated 45° to the orientation illustrated in FIG. 7, and rotation of an internal member to complete an interlock with catches 17 can also be applied to an interlock using two or three catches, instead of the four catches shown in FIG. 7.

The inventive interlock requires only a simple and rapidly actuatable tool for making cuts 16 in the proper position and orientation in the end region of a cylinder 11 to complete a simple and reliable interlock with inner member 15. This can be done by the manufacturer of the caulker 10 before it is filled with contents, or it can be done after caulker 10 is filled and plunger 15 is seated in place. The invention can also be applied to cylinders other than caulker barrels, and those skilled in the art will appreciate the materials, configurations, and methods that can be used in applying the invention to various circumstances.

I claim:

1. An interlock between a cylinder having a wall formed of a resiliently deformable material and a member fitting into the inside of an end region of said cylinder adjacent an end of said cylinder, said interlock comprising:

a. said wall of said cylinder in said end region having a plurality of discrete through cuts evenly spaced from said end of said cylinder;

b. said through cuts being positioned to form catches from the segments of said wall between each of said cuts and said end of said cylinder;

c. each of said catches having a length circumferentially of said wall longer than the width of said catches from said cuts to said end of said cylinder;

d. said member having a body having an interference fit with the inside of said cylinder and slidable from said end of said cylinder inward past said cuts and said catches;

e. said interference fit between said body and said cylinder being sufficient for radially expanding said wall slightly in a region axially inwardly of said cuts and said catches and thereby drawing and holding said catches radially inward from the locus of said cylindrical wall toward a chord orientation relative to said cylindrical locus; and f. said body of said member being seated inside said cylinder axially inward of said cuts so said radially inwardly drawn catches are disposed between said body and said end of said cylinder to interlock with said body and prevent movement of said body toward said end of said cylinder.

2. The interlock of claim 1 wherein said through cuts are formed at an angle oblique to a plane perpendicular to the axis of said cylinder to said catches are slightly wider at their inside surfaces than at their outside surfaces.

3. The interlock of claim 1 wherein said catches are formed slightly wider at their midregions than at their end regions and said through cuts are formed at an angle oblique to a plane perpendicular to the axis of said cylinder so said catches are slightly wider at their inside surfaces than at their outside surfaces.

4. The interlock of claim 1 wherein said cylinder has from two to four of said through cuts and said catches.

5. The interlock of claim 1 wherein said body of said member fitting said cylindrical wall is fully cylindrical.

6. The interlock of claim 1 wherein said body of said member fitting said cylindrical wall is cylindrical in regions adjacent said catches.

7. The interlock of claim 1 wherein said through cuts are formed at an angle oblique to a plane perpendicular to the axis of said cylinder so said catches are slightly wider at their inside surfaces than at their outside surfaces, said body of said member fitting said cylindrical wall has an edge adjacent said catches, and said edge has an inside bevel for facilitating said interlock with said catches.

8. The interlock of claim 1 wherein said member is shaped for closing and sealing said end region of said cylinder.

9. The interlock of claim 1 wherein said cylinder is formed of a resin material as the barrel of a caulker and said member is a closure plunger for said barrel.

10. The interlock of claim 9 wherein said through cuts are formed at an angle oblique to a plane perpendicular to the axis of said cylinder so said catches are slightly wider at their inside surfaces than at their outside surfaces.

11. The interlock of claim 10 wherein said body of said member fitting said cylindrical wall has an edge adjacent said catches and said edge has an inside bevel for facilitating said interlock with said catches.

* * * * *